US008223103B2

(12) United States Patent
Kim et al.

(10) Patent No.: US 8,223,103 B2
(45) Date of Patent: Jul. 17, 2012

(54) LIQUID CRYSTAL DISPLAY DEVICE HAVING IMPROVED VISIBILITY

(75) Inventors: Bo-ra Kim, Asan-si (KR); Sun-kyu Son, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 1041 days.

(21) Appl. No.: 12/214,394

(22) Filed: Jun. 17, 2008

(65) Prior Publication Data

US 2009/0109201 A1 Apr. 30, 2009

(30) Foreign Application Priority Data

Oct. 30, 2007 (KR) ..... 10-2007-0109670

(51) Int. Cl.
*G09G 3/36* (2006.01)

(52) U.S. Cl. ..... 345/94

(58) Field of Classification Search ..... 345/90, 345/99, 206, 208–215
See application file for complete search history.

(56) References Cited

U.S. PATENT DOCUMENTS

| | | | | |
|---|---|---|---|---|
| 6,947,022 | B2 * | 9/2005 | McCartney | 345/99 |
| 6,954,201 | B1 * | 10/2005 | Ludden et al. | 345/204 |
| 7,492,343 | B2 | 2/2009 | Kang et al. | |
| 7,663,594 | B2 * | 2/2010 | Do et al. | 345/100 |
| 7,705,841 | B2 * | 4/2010 | Lin | 345/208 |
| 7,884,653 | B2 * | 2/2011 | Chen et al. | 327/108 |
| 7,898,518 | B2 * | 3/2011 | Hong et al. | 345/99 |
| 7,986,288 | B2 | 7/2011 | Jang et al. | |
| 2005/0128169 | A1 * | 6/2005 | Kang et al. | 345/87 |
| 2005/0140618 | A1 | 6/2005 | Kang et al. | |
| 2006/0001630 | A1 * | 1/2006 | Chen et al. | 345/96 |
| 2006/0012550 | A1 * | 1/2006 | Wang et al. | 345/87 |
| 2006/0164375 | A1 * | 7/2006 | Kim et al. | 345/100 |
| 2006/0164587 | A1 * | 7/2006 | Oh | 349/152 |
| 2007/0030225 | A1 * | 2/2007 | Moon et al. | 345/89 |
| 2007/0046613 | A1 * | 3/2007 | Ha et al. | 345/98 |
| 2008/0036721 | A1 * | 2/2008 | Kim et al. | 345/96 |
| 2008/0278427 | A1 * | 11/2008 | Jang et al. | 345/98 |

FOREIGN PATENT DOCUMENTS

| | | |
|---|---|---|
| CN | 1627144 A | 6/2005 |
| CN | 1991454 A | 7/2007 |
| KR | 10-2007-0016356 | 2/2007 |

OTHER PUBLICATIONS

Shao-Sheng Yang ; Pao-Lin Guo ; Tsin-Yuan Chang ; Jin-Hua Hong, "A multi-phase charge-sharing technique without external capacitor for low-power TFT-LCD column drivers," Jun. 20, 2003, IEEE, Proceedings of the 2003 International Symposium on Circuits and Systems, 2003. ISCAS '03, pp. V-365 to V-368.*

Korean Patent Abstracts, Publication No. 1020070016356, Feb. 8, 2007, 1 pp.

* cited by examiner

*Primary Examiner* — Alexander Eisen
*Assistant Examiner* — Sanjiv D Patel
(74) *Attorney, Agent, or Firm* — Innovation Counsel LLP

(57) ABSTRACT

A liquid crystal display device having improved visibility is disclosed. The liquid crystal display, in accordance with an embodiment, includes a liquid crystal panel including a plurality of display blocks, each display block including a plurality of gate lines, a plurality of data lines, and a plurality of pixels coupled to the corresponding gate lines and data lines; a timing controller providing an integration signal including data and a charge share control signal; and a plurality of data-driving chips corresponding to the plurality of display blocks, each of the data-driving chips being coupled to the timing controller in a point-to-point relation, receiving the integration signal, and short-circuiting the plurality of data lines in the corresponding display blocks with one another during charge-share periods, wherein at least two of the plurality of data-driving chips adjust the charge-share periods to be different from each other.

19 Claims, 7 Drawing Sheets

LIQUID CRYSTAL DISPLAY DEVICE HAVING IMPROVED VISIBILITY

CROSS REFERENCE TO RELATED APPLICATION

This application claims priority from Korean Patent Application No. 10-2007-0109670 filed on Oct. 30, 2007, in the Korean Intellectual Property Office, the disclosure of which is incorporated herein by reference in its entirety.

BACKGROUND

1. Technical Field

The present invention relates generally to a liquid crystal display device.

2. Description of the Related Art

In general, a liquid crystal display device includes a liquid crystal panel that has a lower glass plate on which pixel electrodes are provided, an upper glass plate on which a common electrode is provided, and a liquid crystal layer having dielectric anisotropy and interposed between the lower glass plate and the upper glass plate. An electric field is generated between the pixel electrodes and the common electrode, and transmittance of light through the liquid crystal panel is controlled by adjusting the intensity of the electric field, thereby displaying desired images. The liquid crystal panel includes a plurality of pixels each of which is a minimum image display unit, and the pixels are coupled to corresponding gate lines and data lines, respectively. The liquid crystal display device includes a gate-driving unit and a data-driving unit to drive the plurality of pixels. The gate-driving unit supplies a gate voltage to the individual pixels through the gate lines, and the data-driving unit supplies an image-data voltage to the individual pixels through the data lines.

The data-driving unit may include a plurality of data-driving chips, each of which receives a plurality of control signals and is supplied with a power supply voltage, and generates a data voltage. However, the plurality of data-driving chips may be cascade-coupled to a power-supply-voltage generator for providing a power supply voltage. In this case, while the power supply voltage is supplied to the plurality of data-driving chips, a level of the power supply voltage is decreased due to a resistance component of a voltage line. Accordingly, since each data-driving chip generates a data voltage using a power supply voltage at a different level, visibility of the liquid crystal display device is lowered.

SUMMARY

Systems and methods are disclosed, in accordance with one or more embodiments, to provide a liquid crystal display device having improved visibility.

According to an aspect of an embodiment of the invention, there is provided a liquid crystal display comprising: a liquid crystal panel including a plurality of display blocks, each display block including a plurality of gate lines, a plurality of data lines, and a plurality of pixels coupled to the corresponding gate lines and data lines; a timing controller providing an integration signal including data and a charge share control signal; and a plurality of data-driving chips corresponding to the plurality of display blocks, each of the data-driving chips being coupled to the timing controller in a point-to-point relation, receiving the integration signal, and short-circuiting the plurality of data lines in the corresponding display blocks with one another during charge-share periods, wherein at least two of the plurality of data-driving chips adjust the charge-share periods to be different from each other.

According to another aspect of an embodiment of the invention, there is provided a liquid crystal display comprising: a liquid crystal panel including first and second display blocks, each display block including a plurality of gate lines, a plurality of data lines, and a plurality of pixels coupled to the corresponding gate lines and data lines; and first and second data-driving chips corresponding to the first and second display blocks, the first data-driving chip short-circuiting the plurality of data lines included in the first display block during a first period and applying an image-data voltage to the plurality of data lines included in the first display block, the second data-driving chip short-circuiting the plurality of data lines included in the second display block during a second period different from the first period and applying an image-data voltage to the plurality of data lines included in the second display block.

Details of other embodiments are included in the Detailed Description and the accompanying drawings.

BRIEF DESCRIPTION OF THE DRAWINGS

The above and other features and advantages of embodiments of the present invention will become apparent by describing in detail with reference to the attached drawings in which.

DETAILED DESCRIPTION

Figure 1:
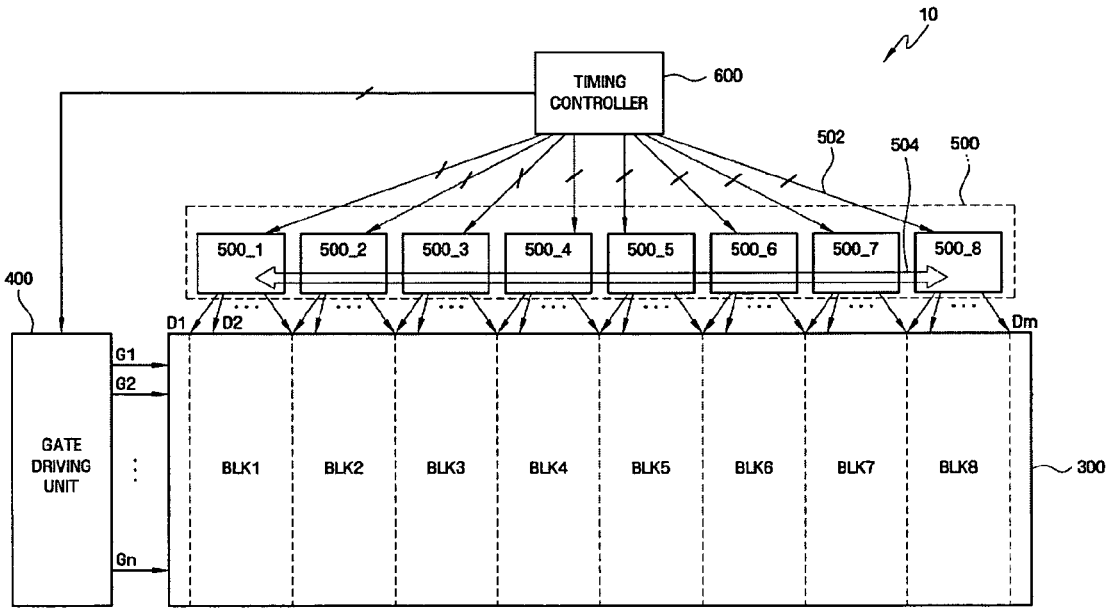
FIG. 1 is a block diagram illustrating a liquid crystal display device according to an embodiment of the invention.

Advantages and features of embodiments of the present invention and methods of accomplishing the same may be understood more readily by reference to the following detailed description and the accompanying drawings. The present invention may, however, be embodied in many different forms and should not be construed as being limited to the embodiments set forth herein. Rather, these embodiments are provided so that this disclosure will be thorough and complete and will fully convey the concept of embodiments of the invention to those skilled in the art. Like reference numerals refer to like elements throughout the specification.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, and/or sections, these elements, components, and/or sections should not be limited by these terms. These terms are only used to distinguish one element, component, or section from another element, component, or section. Thus, a first element, component, or section discussed below could be termed a second element, component, or section without departing from the teachings of the present disclosure.

The terminology used herein is for the purpose of describing exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless explicitly stated otherwise, all of the terminologies (including technical and scientific terminologies) used herein may be used as meaning that those skilled in the art can commonly understand. Furthermore, terminologies defined in ordinary dictionaries should not be ideally or excessively construed, unless explicitly stated otherwise.

Figure 2:
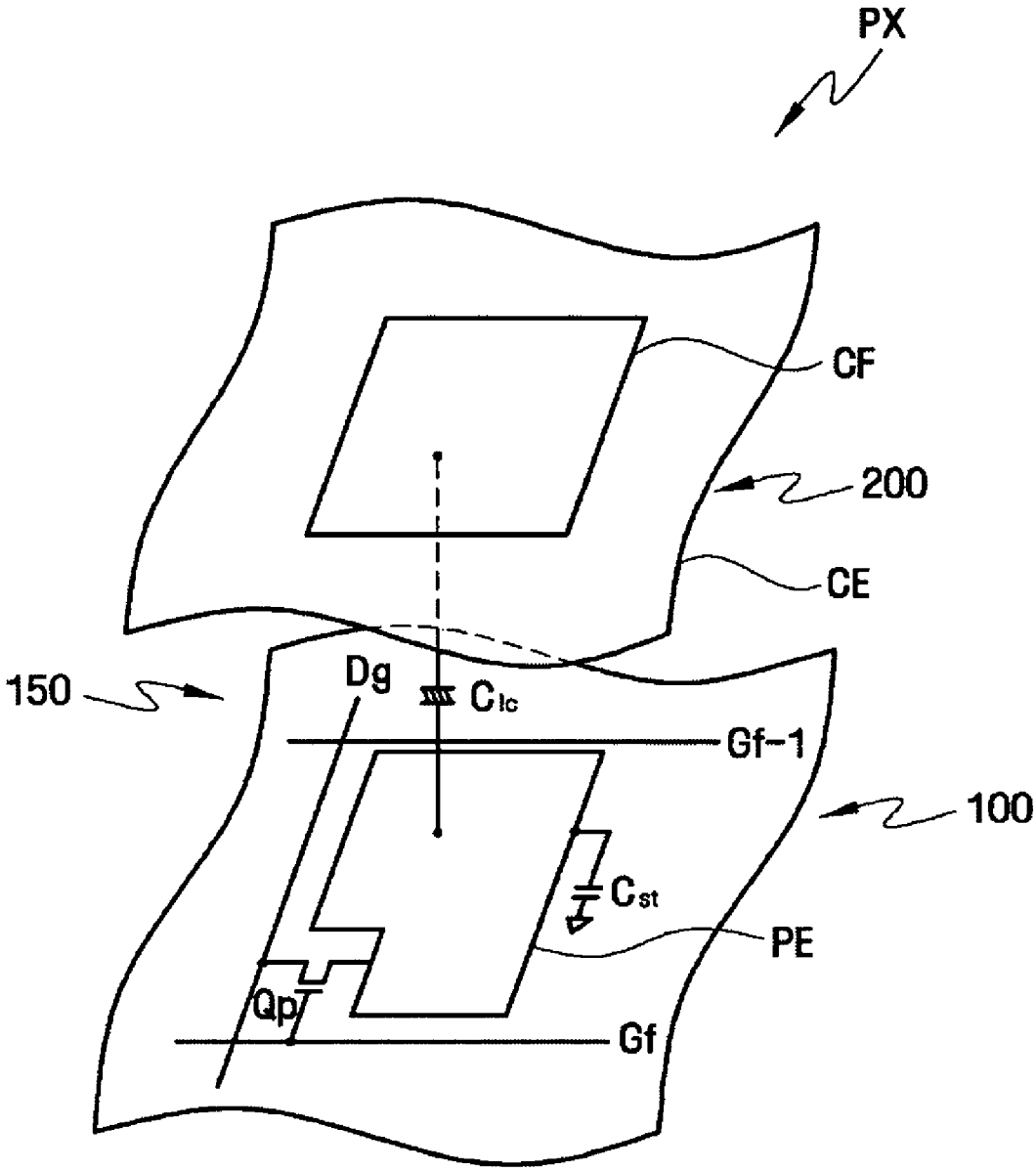
FIG. 2 is an equivalent circuit diagram of one pixel.
Figure 3:
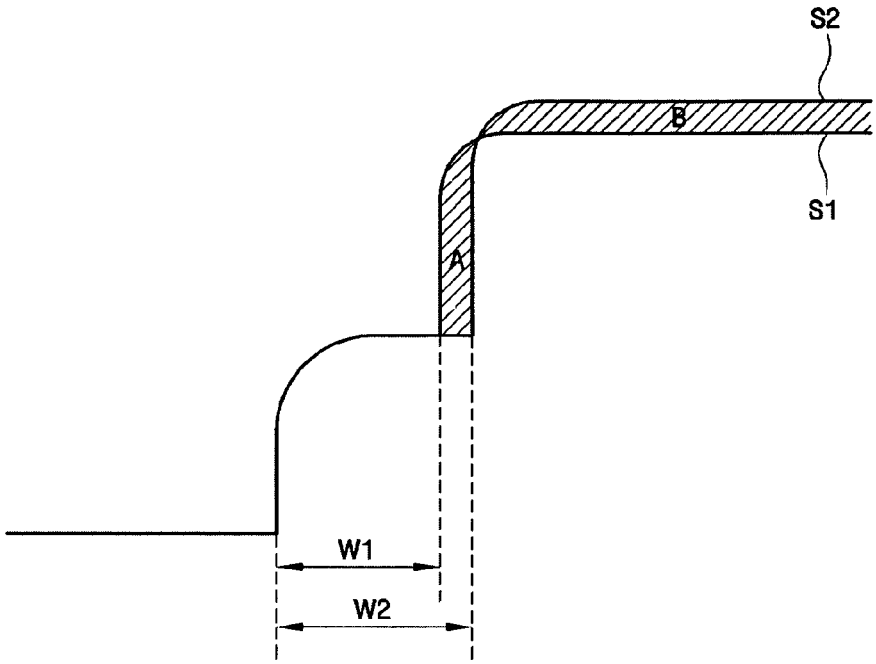
FIG. 3 is a diagram illustrating a comparison result between image-data voltages that are output from a plurality of data-driving chips shown in FIG. 1.

FIG. 1 is a block diagram illustrating a liquid crystal display device according to an embodiment of the invention. FIG. 2 is an equivalent circuit diagram of one pixel. FIG. 3 is a diagram illustrating a comparison result between image-data voltages that are output from the plurality of data-driving chips shown in FIG. 1.

Referring to FIG. 1, a liquid crystal display device 10 includes a liquid crystal panel 300, a gate-driving unit 400, a data-driving unit 500, and a timing controller 600.

First, in an equivalent circuit, the liquid crystal panel 300 includes a plurality of display signal lines G1 to Gn and D1 to Dm, and a plurality of pixels (not shown) that are connected to the plurality of display signal lines G1 to Gn and D1 to Dm. The plurality of display signal lines G1 to Gn and D1 to Dm include a plurality of gate lines G1 to Gn and a plurality of data lines D1 to Dm.

As described above, the liquid crystal panel 300 includes the plurality of pixels. FIG. 2 is an equivalent circuit diagram of one pixel. For example, a pixel PX, which is connected to an f-th gate line Gf (f=1~n) and a g-th data line Dg (g=1~m), includes a switching element Qp that is connected to the gate line Gf and the data line Dg, and a liquid crystal capacitor Clc and a storage capacitor Cst that are connected to the switching element Qp. The liquid crystal capacitor Clc includes the pixel electrode PE provided on a lower glass plate 100 and a common electrode CE provided on an upper glass plate 200. A color filter CF is formed on a portion of the common electrode CE.

The gate-driving unit 400 receives a gate control signal from the timing controller 600, and applies a gate signal to the gate lines G1 to Gn. In this case, the gate signal is composed of a combination of a gate-on voltage Von and a gate-off voltage Voff, which are supplied from a gate on/off voltage generator (not shown). The gate control signal controls the operation of the gate-driving unit 400, and may include a vertical start signal that starts the operation of the gate-driving unit 400, a gate clock signal that determines an output point of time of the gate-on voltage, and an output enable signal that determines a pulse width of the gate-on voltage.

The gate-driving unit 400 may include a plurality of gate driving chips. The plurality of gate driving chips may be directly mounted on the liquid crystal panel 300 or mounted on a flexible printed circuit film (not shown) and may adhere to the liquid crystal panel 300 in the form of a tape carrier package. Alternatively, the gate-driving unit 400 may be integrated in the liquid crystal panel 300 together with the display signal lines G1 to Gn and D1 to Dm and the switching element Qp.

The data-driving unit 500 receives a data control signal from the timing controller 600, and applies the image-data voltages to the data lines D1 to Dm.

Meanwhile, the data-driving unit 500 may include a plurality of data-driving chips 500_1 to 500_8. In FIG. 1, the eight data-driving chips 500_1 to 500_8 are shown, but the invention is not limited thereto. That is, if necessary, the number of data-driving chips used may be less than or greater than 8. In the present embodiment, the plurality of data-driving chips 500_1 to 500_8 may be directly mounted on the liquid crystal panel 300 (e.g., COG (Chip On Glass)) or mounted on a flexible printed circuit film (not shown) and may adhere to the liquid crystal panel 300 in the form of a tape carrier package.

In the liquid crystal display device 10 according to this embodiment, the liquid crystal panel 300 includes a plurality of display blocks BLK1 to BLK8, which correspond to the plurality of data-driving chips 500_1 to 500_8. For example, as shown in FIG. 1, the data-driving chip 500_1 corresponds to the display block BLK1, and the data-driving chip 500_2 corresponds to the display block BLK2.

In particular, the data-driving chips 500_1 to 500_8 are coupled to the timing controller 600 through signal buses 502 in a point-to-point relation. The plurality of data-driving chips 500_1 to 500_8 are cascade-coupled to a power-supply-voltage generator (not shown) providing a power supply voltage through a voltage line 504. The connection relation between the data-driving chips 500_1 to 500_8, the timing controller 600, and the power-supply-voltage generator is exemplified in FIGS. 4 and 5.

The connection relation is specifically described below.

The data-driving chips 500_1 to 500_8 are coupled to the timing controller 600 in a point-to-point relation through the signal buses 502. Therefore, the data-driving chips 500_1 to 500_8 directly receive a data control signal from the timing controller 600 through the signal buses 502. That is, each data-driving chip (for example, data-driving chip 500_1) does not receive the data control signal from another data-driving chip (for example, data-driving chip 500_2) but directly receives the data control signal from the timing controller 600.

In particular, in the present embodiment, the data control signal may include an integration signal, a driving clock, and a data input/output signal. In this case, the integration signal includes data and at least one control signal (for example, a charge-share control signal and an inversion signal). Accordingly, the timing controller 600 can provide the data and at least one control signal through one signal bus 502.

The data control signal is a single-ended signal, and the timing controller 600 and the plurality of data-driving chips 500_1 to 500_8 can communicate with each other by a current-driving method. Accordingly, each of the data-driving chips 500_1 to 500_8 compares a current level of the data provided from the timing controller 600 with a reference current level, and determines whether the current level of the data is a high level or a low level.

Meanwhile, the plurality of data-driving chips 500_1 to 500_8 are cascade-coupled to the power-supply-voltage generator (not shown) by the voltage line 504. Accordingly, a level of the power supply voltage may be decreased due to a resistance component of the voltage line 504, while the power supply voltage is supplied to the plurality of data-driving chips 500_1 to 500_8. For example, when the power supply voltage is supplied to the data-driving chip 500_2, and then supplied to the data-driving chip 500_1, the level of the power supply voltage, which is used by the data-driving chip 500_1, may be lower than a level of the power supply voltage, which is used by the data-driving chip 500_2. Each of the data-driving chips 500_1 and 500_2 generates an image-data voltage using the power supply voltage at a different level. Accordingly, even though each of the data-driving chips 500_1 and 500_2 receives the same data from the timing controller 600, and generates an image-data voltage corresponding to the received data, the image-data voltages, which are output by the data-driving chips 500_1 and 500_2, are different from each other. Accordingly, the amount of charge in pixels in the display block BLK1, which corresponds to the data-driving chip 500_1, becomes different from the amount of charge in pixels in the display block BLK2, which corresponds to the data-driving chip 500_2. As a result, visibility may be different between the display blocks BLK1 and BLK2.

In the present embodiment, the plurality of data-driving chips 500_1 to 500_8 set different charge-share periods and compensate (e.g., improve) the difference in visibility between the display blocks BLK1 to BLK8, which will be described in detail below. Before applying the image-data voltages to the plurality of data lines D1 to Dm, the plurality of data-driving chips 500_1 to 500_8 short-circuit the corresponding data lines D1 to Dm during the predetermined charge-share periods. The data lines D1 to Dm are charged with the image-data voltages having the different polarities while the data lines D1 to Dm are short-circuited, and share the charge. Accordingly, voltage levels of the data lines D1 to Dm are charged to approximately a level of the common voltage Vcom. The data-driving chips 500_1 to 500_8 apply the image-data voltages to the data lines D1 to Dm after the charge-share periods. In this case, time that is needed to charge the data lines D1 to Dm with the image-data voltages is shortened.

Referring to FIG. 3, S1 and S2 denote image-data voltages that are output from the different data-driving chips, respectively. For example, in the case where the data-driving chip 500_1 is supplied with the power supply voltage from another data-driving chip 500_2, if the image-data voltage S1 is the image-data voltage output from the data-driving chip 500_1, the image-data voltage S2 may be the image-data voltage output from the data-driving chip 500_2. In the case where the data-driving chip 500_8 is supplied with the power supply voltage from another data-driving chip 500_7, if the image-data voltage S1 is the image-data voltage output from the data-driving chip 500_8, the image-data voltage S2 may be the image-data voltage output from the data-driving chip 500_7.

For explanatory convenience, the case will be only described in which the data-driving chip 500_1 is supplied with the power supply voltage from another data-driving chip 500_2. That is, S1 denotes the image-data voltage that is output from the data-driving chip 500_1, and W1 denotes a charge-share period of the image-data voltage that is output from the data-driving chip 500_1. S2 denotes the image-data voltage that is output from the data-driving chip 500_2, and W2 denotes a charge-share period of the image-data voltage that is output form the data-driving chip 500_2.

The power supply voltage used in the data-driving chip 500_1 is lower than the power supply voltage used in the data-driving chip 500_2, and thus it can be seen that a voltage level of the image-data voltage S1 is lower than a voltage level of the image-data voltage S2. However the charge-share period W1 of the image-data voltage S1 is shorter than the charge-share period W2 of the image-data voltage S2.

In this case, if the charge-share periods W1 and W2 are adjusted to make areas A and B substantially the same, it is possible to make the amount of charge in the pixels in the display block BLK1 corresponding to the data-driving chip 500_1 the same as the amount of charge in the pixels in the display block BLK2 corresponding to the data-driving chip 500_2. Accordingly, it is possible to compensate the difference in visibility between the display blocks BLK1 and BLK2.

Hereinafter, a method in which the plurality of data-driving chips 500_1 to 500_8 adjust the charge-share periods will be described in detail with reference to FIGS. 4 to 8.

Figure 4:
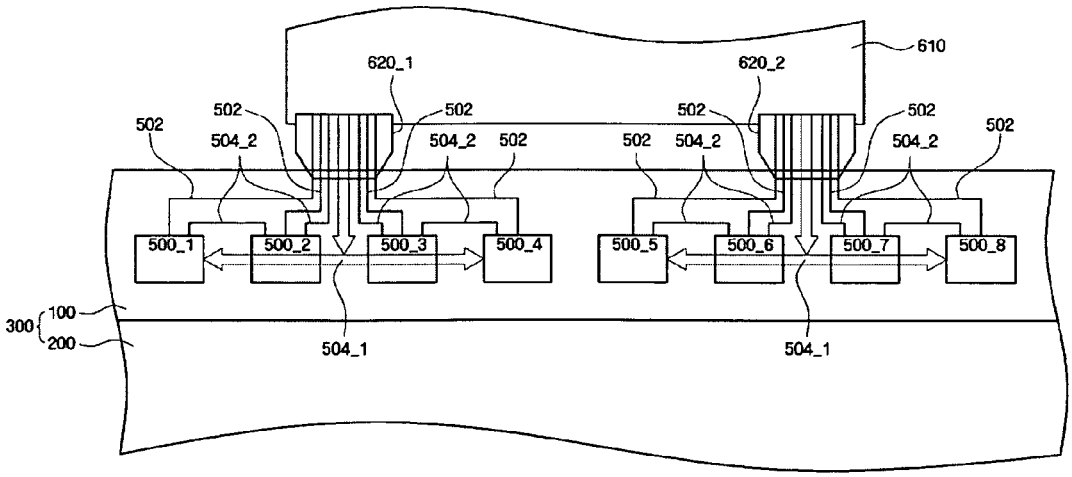
FIGS. 4 and 5 are diagrams illustrating the arrangement of a plurality of data-driving chips, signal buses, and voltage lines shown in FIG. 1.
Figure 5:
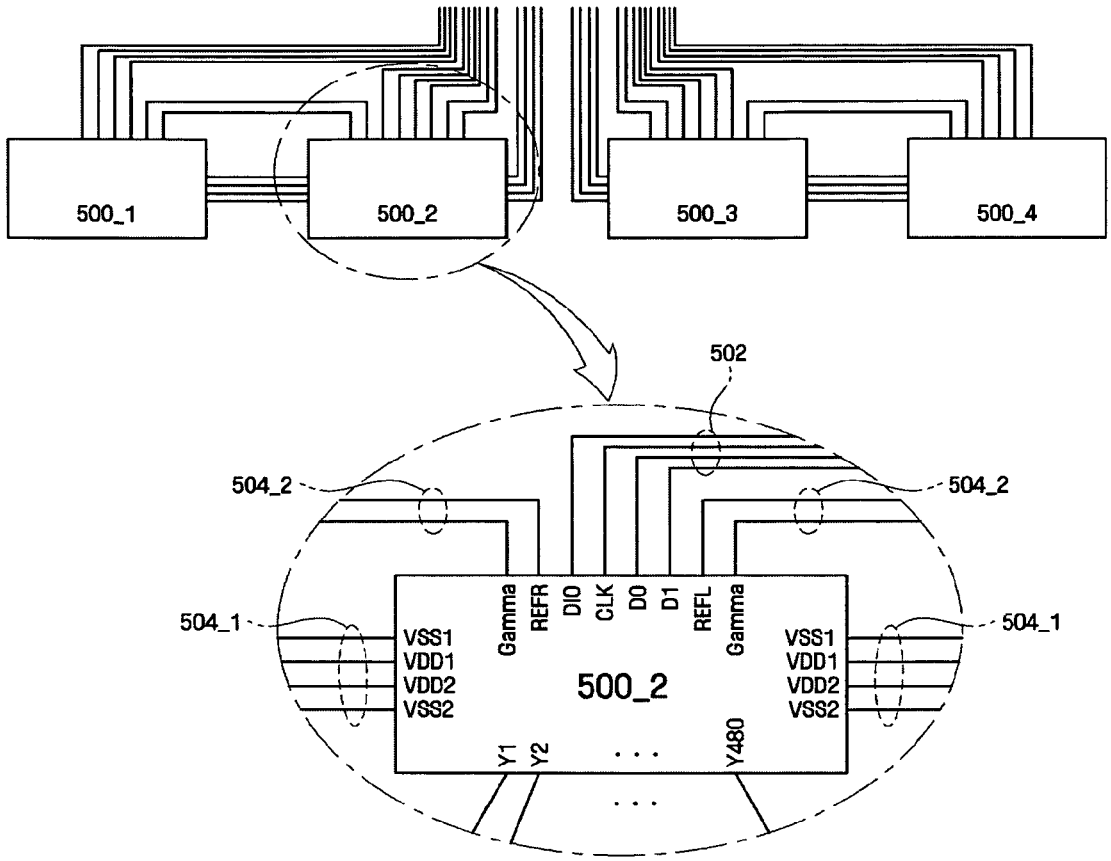

FIGS. 4 and 5 are diagrams illustrating the arrangement of a plurality of data-driving chips, signal buses, and voltage lines shown in FIG. 1. FIG. 4 schematically shows the signal buses and the voltage lines, and FIG. 5 specifically shows the signal buses and the voltage lines.

Referring to FIGS. 4 and 5, the plurality of data-driving chips 500_1 to 500_8 are directly mounted on the lower glass plate 100 of the liquid crystal panel 300 using a COG technology. A timing controller (not shown), a power-supply-voltage generator (not shown), and a gamma voltage generator (not shown) are mounted on a circuit board 610. The liquid crystal panel 300 and the circuit board 610 are bonded to each other by flexible printed circuit films 620_1 and 620_2.

Referring to the arrangement of the plurality of data-driving chips 500_1 to 500_8, the two data-driving chips 500_1 and 500_2 are disposed on the left side of the flexible printed circuit film 620_1, and the two data-driving chips 500_3 and 500_4 are disposed on the right side of the flexible printed circuit film 620_1. In addition, the two data-driving chips 500_5 and 500_6 are disposed on the left side of the flexible printed circuit film 620_2, and the two data-driving chips 500_7 and 500_8 are disposed on the right side of the flexible printed circuit film 620_2. However, the arrangement is only exemplary and the invention is not limited thereto.

As described above, since the plurality of data-driving chips 500_1 to 500_8 and the timing controller 600 are coupled to each other in a point-to-point relation, the plurality of data-driving chips 500_1 to 500_8 receive the data control signal through the corresponding signal buses 502. The data control signal may include first and second integration signals D0 and D1, a data input/output signal DIO, a driving clock CLK, and the like. In this case, the first integration signal D0 may include data and a charge-share signal CSP, and the second integration signal D1 may include data and an inversion signal POL. The data-driving chips 500_1 to 500_8 decode the charge share control signal CSP and adjust the charge-share periods.

Furthermore, the plurality of data-driving chips 500_1 to 500_8 are cascade-coupled to the power-supply-voltage generator and the gamma voltage generator. Specifically, the plurality of data-driving chips 500_1 to 500_8 are supplied with a power supply voltage through a voltage line 504_1, and a gamma voltage through a voltage line 504_2. In this case, the power supply voltage includes logic power supply voltages VDD1 and VSS1, and analog power supply voltages VDD2 and VSS2.

In this structure, since the data-driving chips 500_1 to 500_8 are cascade-coupled to the power-supply-voltage generator, each of the data-driving chips 500_1 to 500_8 may use the power supply voltage at a different level. However, the data-driving chips 500_1 to 500_8 are coupled to the timing controller in a point-to-point relation. Accordingly, each of the data-driving chips 500_1 to 500_8 receives the charge share control signal CSP, which allows a charge-share period to be adjusted, from the timing controller. As a result, the data-driving chips 500_1 to 500_8 can appropriately adjust the charge-share periods.

Figure 6:
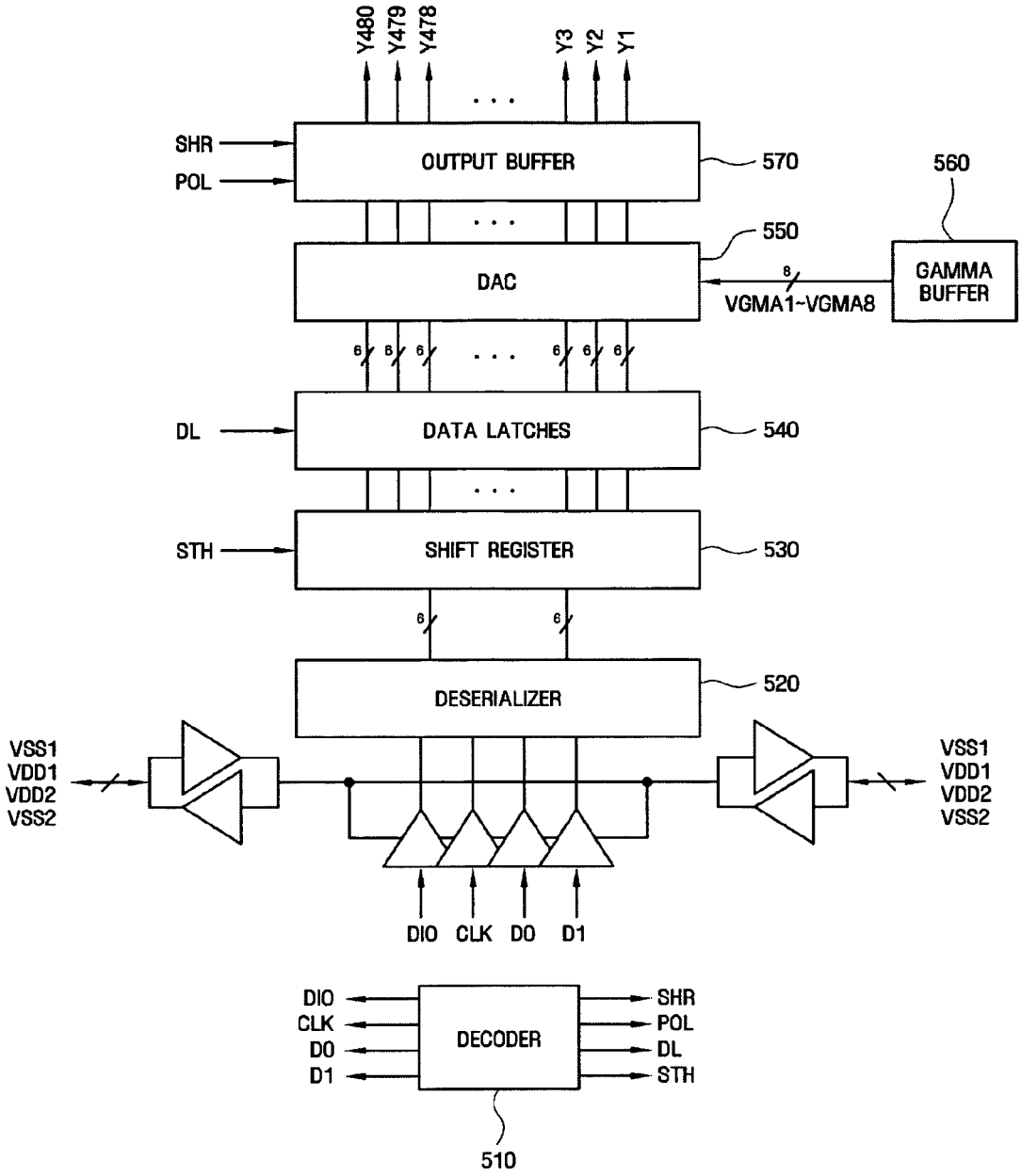
FIG. 6 is a block diagram illustrating an internal structure of a data-driving chip shown in FIG. 1.
Figure 7:
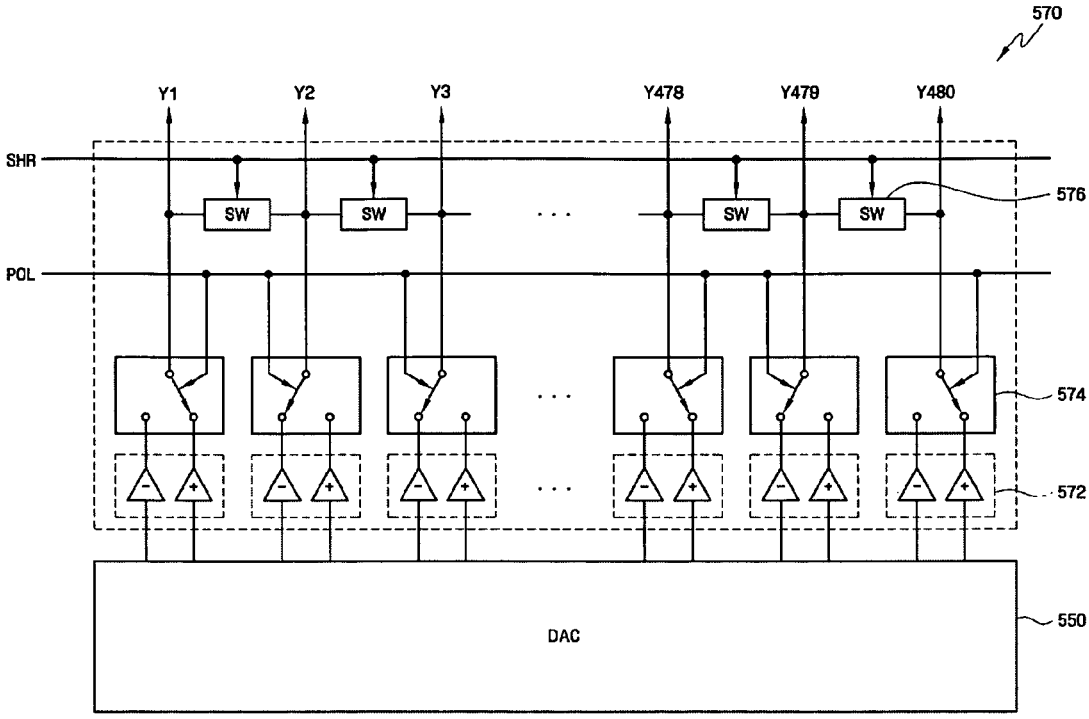
FIG. 7 is a circuit diagram illustrating the output buffer shown in FIG. 6.

Hereinafter, the internal structure of the data-driving chip will be described with reference to FIGS. 6 and 7. FIG. 6 is a block diagram illustrating an internal structure of the data-driving chip shown in FIG. 1. FIG. 7 is a circuit diagram illustrating an output buffer shown in FIG. 6.

Referring to FIG. 6, each of the data-driving chips 500_1 to 500_8 includes a decoder 510, a deserializer 520, a shift register 530, a data latch 540, a digital-to-analog converter 550 (DAC), a gamma buffer 560, and an output buffer 570.

The decoder 510 receives the data input/output signal DIO, the driving clock CLK, and the first and second integration signals D0 and D1 from the timing controller 600, decodes them, and provides a charge-share signal SHR, an inversion signal POL, a latch instruction signal DL, and a horizontal start signal STH. Specifically, the charge-share signal SHR is used to short circuit the plurality of data lines for the plurality of data lines to share the charge. The inversion signal POL is used to select a polarity of the image-data voltage. The latch instruction signal DL is used to determine when the data latch 540 starts the operation. The horizontal start signal STH is used to determine when the data-driving chip starts the operation.

The deserializer 520 rearranges data in the serially input first and second integration signals DO and D1 to a parallel format.

The shift register 530 receives the horizontal start signal STH and starts the operation, and sequentially provides the data, received via the deserializer 520, to the data latch 540.

The data latch 540 receives the latch instruction signal DL and starts the operation. The data latch 540 receives the data from the shift register 530, latches the received data, and provides the data to the digital-to-analog converter 550.

The digital-to-analog converter 550 is supplied with the gamma voltages VGMA1 to VGMA8 from the gamma buffer 560, and converts the digital data into analog image-data voltages Y1 to Y480. In this case, each of the image-data voltages, which are output by the digital-to-analog converter 550, indicates a gray-scale level voltage.

The output buffer 570 receives the inversion signal POL and selects the polarity of each of the image-data voltages Y1 to Y480. In addition, the output buffer 570 receives the charge-share signal SHR and short-circuits the data lines, such that the charge is shared by the data lines. As shown in FIG. 7, the output buffer 570 includes buffer circuits 572, first switching units 574, and second switching units 576. The buffer circuit 572 outputs a positive image-data voltage and a negative image-data voltage. The first switching unit 574 receives the inversion signal POL, and selects any one of the positive image-data voltage and the negative image-data voltage, and outputs the selected voltage. The second switching unit 576 receives the charge-share signal SHR and short-circuits the plurality of data lines during the charge-share period. For example, the second switching unit 576 may be a MOS transistor that is turned on when receiving the charge-share signal SHR.

Figure 8:
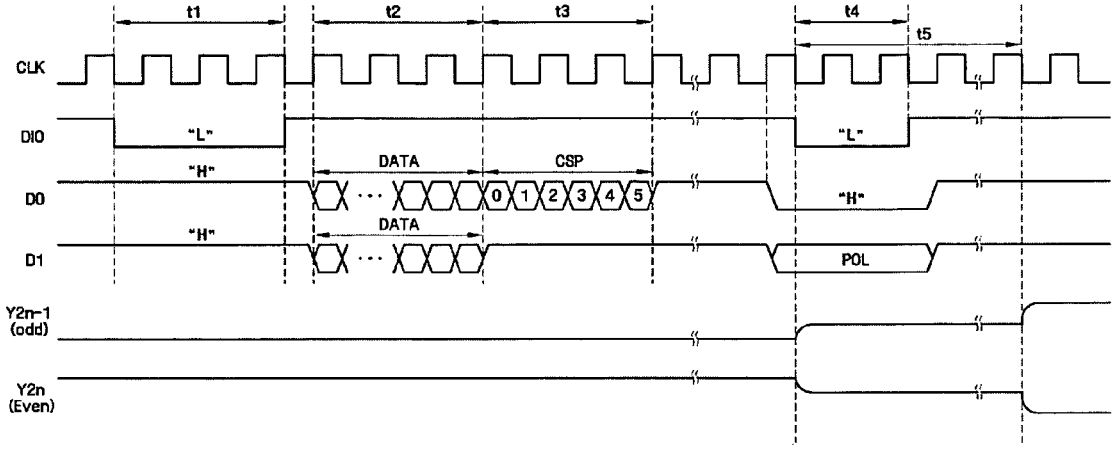
FIG. 8 is a timing chart illustrating the operation of the data-driving chip shown in FIG. 1.

Hereinafter, the operation of the data-driving chip will be described with reference to FIGS. 6 to 8. FIG. 8 is a timing chart illustrating the operation of the data-driving chip shown in FIG. 1.

Referring to FIG. 8, when the data input/output signal DIO is at a low level and the first and second integration signals D0 and D1 are at a high level for three clock cycles of the driving clock CLK (see interval t1), the decoder 510, which is provided in each of the data-driving chips 500_1 to 500_8, outputs the horizontal start signal STH.

The shift register 530 receives the horizontal start signal STH, and starts the operation. During the interval t2, the shift register 530 receives the data in the first and second integration signals D0 and D1.

Then, the decoder 510 receives a 6-bit charge share control signal CSP in the first integration signal D0, decodes the 6-bit charge share control signal CSP, and generates the charge-share signal SHR. The 6-bit charge-share signal can determine the charge-share period. For example, the charge-share period that is determined by the 6-bit charge-share signal is shown in Table 1. When the charge-share signal CSP is 001000, the charge is shared for 17 clock cycles of the driving clock CLK. That is, the interval t5, where the charge is shared by the plurality of data lines, becomes 17 clock cycles. Accordingly, the data-driving chip adjusts the charge-share period according to the value of the charge share control signal CSP. That is, the timing controller differently sets values of the charge share control signals CSP that are applied to the plurality of data-driving chips, and adjusts the charge-share period.

TABLE 1

Example of relation between charge-share signal and charge-share period

| CSP[5:0] | | | | | | |
|---|---|---|---|---|---|---|
| Bit5 | Bit4 | Bit3 | Bit2 | Bit1 | Bit0 | Charge-share period |
| 0 | 0 | 0 | 0 | 0 | 0 | N/A |
| 0 | 0 | 0 | 0 | 0 | 1 | N/A |
| 0 | 0 | 0 | 0 | 1 | 0 | N/A |
| 0 | 0 | 0 | 0 | 1 | 1 | N/A |
| 0 | 0 | 0 | 1 | 0 | 0 | 9 clk |
| 0 | 0 | 0 | 1 | 0 | 1 | 11 clk |
| 0 | 0 | 0 | 1 | 1 | 0 | 13 clk |
| 0 | 0 | 0 | 1 | 1 | 1 | 15 clk |
| 0 | 0 | 1 | 0 | 0 | 0 | 17 clk |
| ... | ... | ... | ... | ... | ... | ... |
| 1 | 1 | 1 | 1 | 0 | 1 | 123 clk |
| 1 | 1 | 1 | 1 | 1 | 0 | 125 clk |
| 1 | 1 | 1 | 1 | 1 | 1 | 127 clk |

When the data input/output signal DIO is at a low level during two clock cycles of the driving clock (see interval t4), the decoder 510 provides a latch instruction signal DL. The data latch 540 receives the latch instruction signal DL and starts the operation.

The digital-to-analog converter 550 is supplied with the gamma voltages VGMA1 to VGMA8 from the gamma buffer 560, and converts the digital data into the analog image-data voltage. In this case, each of the image-data voltages that are output by the digital-to-analog converter 550 indicates a gray-scale level voltage.

The output buffer 570 receives the inversion signal POL, and selects the polarities of the image-data voltages Y1 to Y480. In addition, the output buffer 570 receives the charge-share signal SHR, and short-circuits the data lines such that the charge is shared by the data lines.

In the liquid crystal display device that has been described above, each of the data-driving chips adjusts the charge-share period, thereby improving visibility.

Although various embodiments of the present invention have been disclosed for illustrative purposes, those skilled in the art will appreciate in light of the foregoing that various modifications, additions and substitutions are possible, without departing from the scope and spirit of the present teachings.

What is claimed is:

1. A liquid crystal display device comprising:

a liquid crystal panel including a plurality of display blocks, each display block having a plurality of gate lines extending therethrough and including a respective plurality of data lines, and a respective plurality of pixels each coupled to a corresponding one of the gate lines and a respective one of the data lines;

a plurality of data-driving chips;

a timing controller configured to serially provide a respective integrated signal respectively to each of the data-driving chips on a point-to-point basis, where each respective integrated signal includes respective data signals for its respective data-driving chip and a charge share control signal for its respective data-driving chip; and wherein each of the a plurality of data-driving chips corresponds to a respective one of the plurality of display blocks, wherein each of the data-driving chips is coupled to the timing controller according to said serial point-to-point basis for thereby serially receiving its respective integrated signal, and wherein each of the data-driving chips is configured to provide short-circuiting between its respective data lines of its respective display block during a charge-share period whose duration is defined by the charge share control signal included in the received integrated signal of that respective data-driving chip, wherein the timing controller is configured to output different charge share control signals to at least two of the plurality of data-driving chips to thereby cause their respective charge-share periods to be different from each other.

2. The liquid crystal display device of claim 1, further comprising:

a power-supply-voltage generator configured to generate a power supply voltage, wherein the plurality of data-driving chips are cascade-coupled to the power-supply-voltage generator.

3. The liquid crystal display device of claim 2, wherein:

the plurality of data-driving chips comprises first and second data-driving chips, and the second data-driving chip is supplied with the power supply voltage as cascade coupled through the first data-driving chip, and wherein the timing controller is configured to cause the second data-driving chip to have a respective charge-share period that is shorter than that of the first data-driving chip.

4. The liquid crystal display device of claim 2, wherein each of the data-driving chips is configured to generate from supplied image data signals included in the respectively received integrated signal, corresponding analog image-data voltages to drive the corresponding data lines.

5. The liquid crystal display device of claim 1, wherein each of the data-driving chips comprises:

a decoder coupled for receiving the integrated signal and configured for providing a charge-share signal having a duration defined by information included in the received integrated signal; and a plurality of switching elements formed between the plurality of data lines and short-circuiting the plurality of data lines with one another in response to the charge-share signal.

6. The liquid crystal display device of claim 1, wherein the integrated signal is a single-ended signal.

7. The liquid crystal display device of claim 1, wherein the timing controller and the plurality of data-driving chips are configured to communicate with each other by a current-driving method.

8. The liquid crystal display device of claim 1, wherein the plurality of data-driving chips are mounted on the liquid crystal panel using a COG (Chip On Glass) technology.

9. A liquid crystal display device comprising:

a liquid crystal panel including first and second display blocks, each display block having a plurality of gate lines extending therethrough and including a plurality of data lines, and a plurality of pixels coupled to the corresponding gate lines and data lines; and first and second data-driving chips corresponding to the first and second display blocks, the first data-driving chip being configured to selectively provide short-circuiting of its respective plurality of data lines included in the first display block during a first period of respective first duration and being configured for applying image-data voltages to its respective plurality of data lines included in the first display block in a subsequent period, the second data-driving chip being configured to selectively provide short-circuiting of its respective plurality of data lines included in the second display block during a second period of respective second duration and being configured for applying image-data voltages to its respective plurality of data lines included in the second display block;

wherein the first and second durations are different from one another.

10. The liquid crystal display device of claim 9, further comprising a timing controller configured for providing a first charge-share signal to the first data-driving chip and a second charge-share signal to the second data-driving chip, wherein the first and second charge-share signals cause the corresponding first and second data-driving chips to have the different first and second durations.

11. The liquid crystal display device of claim 10, wherein the timing controller provides a first integration signal including data and the first charge-share signal to the first data-driving chip and a second integration signal including data and the second charge-share signal to the second data-driving chip.

12. The liquid crystal display device of claim 11, wherein the first and second integration signals are single-ended signals.

13. The liquid crystal display device of claim 10, wherein the first and second data-driving chips are coupled to the timing controller in a point-to-point relation.

14. The liquid crystal display device of claim 10, wherein the timing controller and the first and second data-driving chips are configured to communicate with each other using a current-driving method.

15. The liquid crystal display device of claim 9, further comprising: a power-supply-voltage generator configured for generating a power supply voltage that is coupled for transmission to the first and second data-driving chips.

16. The liquid crystal display device of claim 15, wherein the first and second data-driving chips and the power-supply-voltage generator are cascade-coupled to each other.

17. The liquid crystal display device of claim 16, wherein the second data-driving chip is supplied with the power supply voltage through the first data-driving chip, and the second duration is shorter than the first period.

18. The liquid crystal display device of claim 9, wherein the first and second data-driving chips are mounted on the liquid crystal panel using a COG (Chip On Glass) technology.

19. The liquid crystal display device of claim 1, wherein the plurality of data-driving chips are cascade-coupled one to the next so as to receive power-supply-voltages in a cascade connected manner whereby some chips may receive lower power-supply-voltages than others; and the timing controller is configured to output the different charge share control signals to the at least two of the plurality of data-driving chips based on the different cascade provided power-supply-voltages that the respective data-driving chips receive.

* * * * *